US007758707B2

(12) United States Patent
Millward

(10) Patent No.: US 7,758,707 B2
(45) Date of Patent: Jul. 20, 2010

(54) MARTENSITIC STAINLESS STEEL AND METHOD OF THE MANUFACTURE

(75) Inventor: Chris Millward, South Yorkshire (GB)

(73) Assignee: Outokumpu Oyj, Espoo (FI)

( * ) Notice: Subject to any disclaimer, the term of this patent is extended or adjusted under 35 U.S.C. 154(b) by 208 days.

(21) Appl. No.: 11/455,136

(22) Filed: Jun. 16, 2006

(65) Prior Publication Data

US 2007/0000580 A1 Jan. 4, 2007

(30) Foreign Application Priority Data

Jun. 30, 2005 (EP) ..... 05014295

(51) Int. Cl.
*C22C 38/44* (2006.01)
*C21D 8/00* (2006.01)
*C21D 9/18* (2006.01)

(52) U.S. Cl. ..... 148/325; 148/335; 148/608; 148/610; 148/547; 148/651; 148/652

(58) Field of Classification Search ..... 148/325, 148/547, 608, 610, 651, 652, 335; 420/64, 420/67, 68
See application file for complete search history.

(56) References Cited

U.S. PATENT DOCUMENTS 4,180,420 A 12/1979 Alexander et al.
6,273,973 B1 8/2001 Parayil et al.

FOREIGN PATENT DOCUMENTS

| | | | |
|---|---|---|---|
| EP | 0485641 | | 5/1992 |
| JP | 53-114719 | * | 10/1978 |
| JP | 61034161 | | 2/1986 |
| JP | 2001-049399 | * | 2/2001 |

OTHER PUBLICATIONS

Computer-generated English translation of Japanese patent 2001-049399, Uehara, Feb. 20, 2001.*
English abstract of Japanese patent 363274745, Nakayama et al., Nov. 11, 1988.*
Derwent Acc-No. 1978-81268, English abstract of Japanese patent 53-114719, Oct. 6, 1978.*
Human-English translation of Japanese patent 53114719, Murakawa et al., Oct. 5, 1978.*
Structure and Properties of Engineering Materials, "Tempering of martensite", pp. 152-155, Brick, Pense and Gordon, 4th Edition, 1977.*
Human-English translation of Japanese patent 53114719, Murakawa et al., Oct. 6, 1978.*

* cited by examiner

*Primary Examiner*—Deborah Yee
(74) *Attorney, Agent, or Firm*—Chernoff, Vilhauer, McClung & Stenzel

(57) ABSTRACT

The invention relates to a martensitic stainless steel to be used for making a razor, surgical and similar blades or other cutting tools, which steel contains 0.40 to 0.55 wt % carbon, 0.8 to 1.5 wt % silicon, 0.7 to 0.85 wt % manganese, 13.0 to 14.0 wt % chromium, 1.0 to 1.5 wt % molybdenum and 0.2 to 0.4 wt % nickel, 0.02 to 0.04 wt % nitrogen, the balance of the steel being iron and inevitable impurities. The invention also relates to a method of manufacturing the said steel.

6 Claims, 1 Drawing Sheet

MARTENSITIC STAINLESS STEEL AND METHOD OF THE MANUFACTURE

Figure 1:
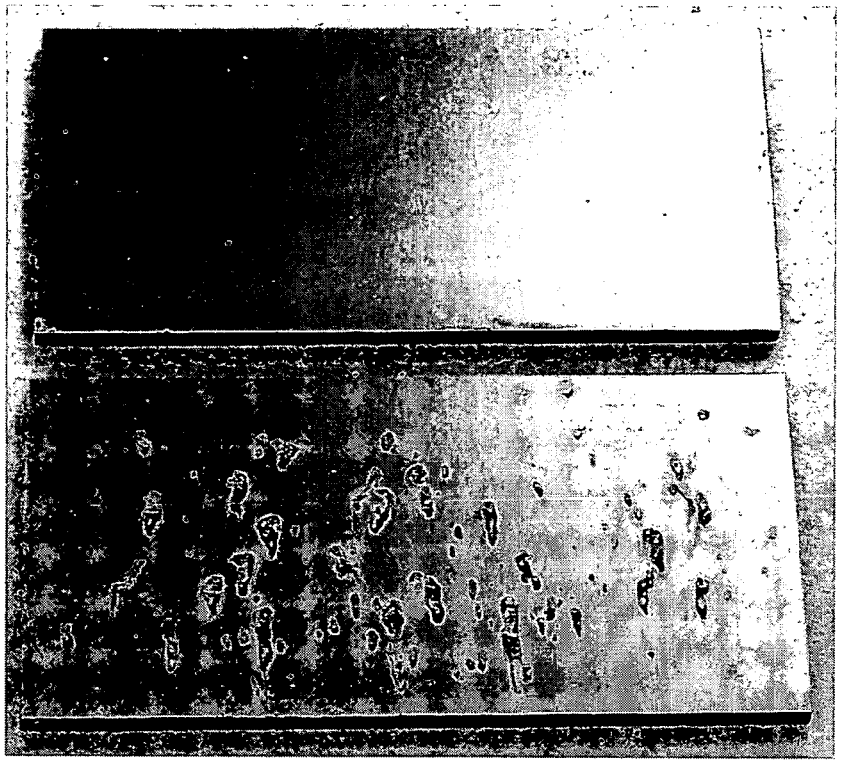

This application claims priority under 35 USC 119 of European Patent Application No. 05014295.9 filed Jun. 30, 2005.

The invention relates to a martensitic stainless steel to be used for making a razor, surgical and similar blades having improved corrosion resistance and resistance to sintering and to a method of manufacturing the said steel.

High carbon low alloy steels containing approximately 1.3 wt % carbon and less than 0.4 wt % chromium were the original materials for producing razor blades. These blades, when correctly hardened and tempered exhibited very high hardness with excellent response to sharpening by grinding. The main drawbacks with these steels were their poor corrosion resistance in aqueous environments and the tendency to soften to unacceptable levels when exposed to the sintering process used during the application of Teflon coatings.

The environment in which the razor blade is used usually involves extended exposure to aqueous solutions and storage of the blades is often in warm and humid conditions i.e. in bathrooms. These operating conditions are frequently too aggressive for a low alloy, high carbon steel and corrosion results. In addition, the softening that often occurs during Teflon sintering, makes the blade less capable of maintaining its sharp cutting edge.

The 13 wt % chromium, 0.7 wt % carbon stainless razor steel (Trade name: Silver Fox 100) was developed to overcome both of these issues. The relatively high chromium and carbon contents leave this martensitic stainless steel capable of resisting the excessive loss of hardness during polytetrafluoroethylene (PTFE) sintering, and the chromium content provides sufficient corrosion resistance for more extensive use in the previously discussed environment.

As the razor blade market developed rapidly, the performance of the blades with respect to durability and shaving comfort was improved by addition of surface coatings such as: chromium nitride, platinum, chromium or diamond.

These coatings had the effect of increasing the corrosion and wear resistance adjacent to the blade edge, but the blade body was still susceptible to corrosion in the extended periods of use that are made possible by the coatings. In addition, during this period of market development, the market was moving towards disposable and cartridge based razors. The design of these disposable and cartridge based razors sometimes involved the presence of crevices, which can be sites for accelerated corrosion attack.

In 1971, UDDEHOLMS AKTIEBOLAG lodged GB Patent No. 1400412, detailing an electroslag remelting based method for minimising oxide inclusions in a range of razor blade steels. This patent also mentions the addition of silicon for reducing the reduction in hardness that results in blade steels during sintering of PTFE coatings.

In 1986, JP Patent No. 61034161, from KAWASAKI STEEL CO. identified steel, which avoided the formation of eutectic carbide formation to minimise edge breakage and maximise hot and cold workability. This steel contained a reduced percentage of carbon in conjunction with an addition of nitrogen and aluminium, compared to conventional blade steels.

The DE Patent No. 3901470 lodged by VEREINIGTE SCHMEIDEWERKE GmbH detailed a cold-work martensitic steel which was principally intended to be a material for polyvinylchroride (PVC) manufacturing but was identified as being possibly used for razor blades.

A variation from the conventional razor blade steels was covered in EP Patent No. 485641 lodged jointly by WILKINSON SWORD GmbH and HITACHI METALS Ltd. This patent detailed a more corrosion resistant blade steel and a method of manufacture. The composition of this alloy varied from conventional blade steels by having lower carbon content and an addition of molybdenum.

The object of the present invention is to eliminate some drawbacks of the prior art and to achieve an improved martensitic stainless steel and a method for its manufacture. The invention is to be used as a material for razor, surgical and similar blades having good corrosion resistance and sintering resistance. The essential features of the invention are enlisted in the appended claims.

In one embodiment of the invention the martensitic stainless steel to be used for making a razor, surgical and similar blades or other cutting tools contains 0.40 to 0.55 wt % carbon, 0.8 to 1.5 wt % silicon, 0.7 to 0.85 wt % manganese, 13.0 to 14.0 wt % chromium, 1.0 to 1.5 wt % molybdenum and 0.2 to 0.4 wt % nickel, 0.02 to 0.04 wt % nitrogen, the balance of the steel being iron and inevitable impurities. Optionally the matensitic stainless steel of the invention can also contain small amounts of at least one element of the group tin, titanium and boron as alloyed components.

In another embodiment of the invention the martensitic stainless steel to be used for making a razor, surgical and similar blades or other cutting tools contains 0.45 to 0.55 wt % carbon, 1.0 to 1.5 wt % silicon, 0.7 to 0.85 wt % manganese, 13.0 to 13.5 wt % chromium, 1.0 to 1.5 wt % molybdenum and 0.25 to 0.35 wt % nickel, 0.02 to 0.04 wt % nitrogen, 0 to 0.002 wt % boron the balance of the steel being iron and inevitable impurities. Optionally the matensitic stainless steel of the invention can also contain small amounts of at least one element of the group tin and titanium as alloyed components so that the titanium content is between 0.010 and 0.015 wt % and the tin content between 0.010 and 0.030 wt %.

In the following table 1 the steel of the invention with the contents of A, B, C and D is compared with the steels of the prior art under the trade names of Silver Fox 77 "SF77" and Silver Fox 100 "SF100".

| | Chemical Composition (Wt %) | | | | | | | | | | | | |
|---|---|---|---|---|---|---|---|---|---|---|---|---|---|
| Steel | C | Si | Mn | P | S | Cr | Mo | Ni | N | Sn | Ti | B | Fe |
| SF100 | 0.68 | 0.30 | 0.70 | 0.022 | 0.005 | 13.0 | 0.02 | 0.10 | 0.035 | 0.005 | — | — | Bal |
| A | 0.50 | 1.30 | 0.70 | 0.025 | 0.002 | 13.0 | 1.50 | 0.25 | 0.020 | 0.30 | 0.010 | 0.001 | Bal |
| B | 0.55 | 1.50 | 0.70 | 0.025 | 0.002 | 13.5 | 1.10 | 0.25 | 0.020 | 0.010 | 0.010 | — | Bal |
| C | 0.40 | 0.80 | 0.85 | 0.010 | 0.005 | 13.0 | 1.50 | 0.20 | 0.030 | — | — | — | Bal |
| D | 0.45 | 1.00 | 0.70 | 0.010 | 0.005 | 13.5 | 1.00 | 0.20 | 0.040 | — | 0.015 | 0.002 | Bal |
| SF77 | 0.53 | 0.27 | 0.67 | 0.011 | 0.014 | 14.7 | — | 0.10 | — | 0.005 | — | — | Bal |

When comparing the steel of the invention with the steels of the prior art, the critical changes to the alloying elements, from a corrosion improvement point of view, are the reduction in carbon, increase in silicon and increase in molybdenum. Elements that supplement the attainable hardness in the finished razor blades include silicon, nitrogen and boron.

The martensitic stainless steel of the invention is in accordance with one preferred embodiment produced from a raw material, such as carefully selected steel scrap, in a combination of an electric arc furnace and a secondary refining furnace and can be cast by either ingot or continuous casting. Naturally, the raw material for the steel of the invention can also be produced in a primary steel smelter which molten steel is then cast by either ingot or continuous casting. The cooling rate of the cast products is controlled to avoid thermal shock. Rolling of the cast products is carried out directly in a hot rolling mill capable of rolling in a temperature range between 1200 and 1300° C.

The annealing of the hot-rolled stainless steel of the invention is carried out in continuous or batch heat treatment furnaces. The required anneal necessitates controlled heating to a temperature range of 925-975° C. followed by a long term soak and a controlled cooling. The fully annealed product reaches a Vickers hardness of approximately Hv 250, which makes it suitable for initial cold rolling.

Cold rolling of the steel involves use of rolling mills with careful steering and shape control. Regular sub-critical annealing treatments are necessary to restore ductility. The temperature of the sub-critical annealing should be in the temperature range between 675 and 750° C. restoring the hardness to approximately Hv 280.

The steel of the invention can be readily welded using a variety of welding processes. The resulting welds are strong enough to roll, especially after annealing.

Final cold rolling of the invented steel in the form of a strip needs to achieve a hardness range appropriate for perforating during razor production and a surface finish that has the emissivity that allows rapid hardening. Cold rolled gauges between 0.07 mm and 0.15 mm are possible within precision gauge tolerances. Further, the invented steel can be slit using standard rotary slitting machines to widths between 350 mm and 3 mm within precision width tolerances.

The martensitic stainless steel of the invention is further capable of being perforated using standard blade perforation equipment without excessive burr or deformation. The relatively high corrosion resistance of the invented steel negates the need to apply rust preventative oil and, therefore, it may be necessary to add lubricating oil during perforation.

The steel of the invention is hardened using standard razor blade hardening lines at the temperature range between 1150 and 1200° C. After hardening the hardened steel is tempered at the temperature range between 130 and 280° C. The tempering temperature that should be used for the hardened steel depends largely on the level of ductility that is required. The range of Vickers hardness, that is possible for the invented steel is in the range of $Hv_1$ 700-780 with retained austenite levels being in the range of 20%±5%, similar to the conventional steel. When the tempering temperature is carefully selected the invented steel is sufficiently ductile to be processed into blades without unexpected fractures and is suitable for separation by whatever method is commonly used for the conventional steel.

The invented steel is capable of being sharpened to a very good edge with cutting force measurements being at least as good as the conventional steel. In addition, the invented steel is more resistant to loss of hardness during subsequent processing with typical finished blade hardness in the range of $Hv_1$ 600-680. This slightly reduced hardness does not have any significant effect on blade tip durability.

Figure 2:
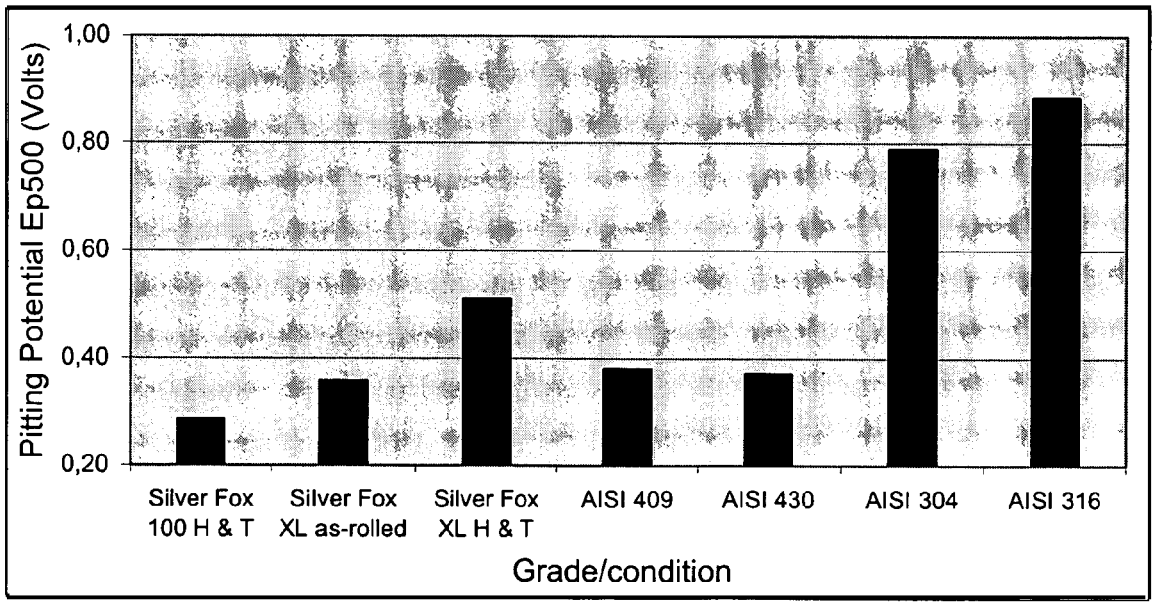

The invention is described in more details referring to the appended drawing wherein FIG. 1 shows a comparative salt spray corrosion test samples for the martensitic stainless steel of the invention and one steel of the prior art, and FIG. 2 illustrates a comparison of the relative pitting potential of the steel of the invention against a variety of standard stainless steel grades.

The salt spray corrosion test of FIG. 1 was carried out in water solution with 5% NaCl at the temperature of 20° C. for 6 hours. The test sample "Silver Fox XL" in FIG. 1 represents the martensitic stainless steel of the invention and the test sample "conventional steel" represents "Silver Fox 100" of the prior art. FIG. 1 clearly shows the improved performance of the steel of the invention when comparing with the conventional steel.

FIG. 2 illustrates a more quantitative measure of corrosion resistance, the relative pitting potential, for the martensitic stainless steel of the invention "Silver Fox XL" as well as "Silver Fox 100" of the prior art and for information,—other standards stainless steel grades. The steel of the invention "Silver Fox XL" is illustrated in two modes; the first one "Silver Fox XL as rolled" after cold rolling and the second one "Silver Fox XL H&T" after hardening and tempering. The determinations for the relative pitting potential for the samples of the steels were carried out in a flat cell, using a 0.01% chloride electrolyte, having the pH value of 7, with a sodium acetate or acetic acid buffer to ensure suitable conductivity. After two minutes at open circuit, the potential was ramped at a rate of 1 mV/s until a current density of 800 to 900 μA/cm2 was achieved. The steel samples were then examined for pitting. The pitting potential Ep500 for the cold rolled steel of the invention "Silver Fox XL as rolled" is 0.358 V and for the tempered steel of the invention "Silver Fox XL H&T" is 0.510 V. Thus the pitting potential Ep500 for the martensitic stainless steel of the invention is between 0.35 V and 0.52 V.

From FIG. 2 it is noticed that the pitting potential of the invented steel in the tempered condition "Silver Fox XL H&T" is clearly higher than the pitting potential 0.286 V for the equivalent conventional steel "Silver Fox 100 H&T" in the tempered condition, as also indicated by the previous results. The more impressive indication from the pitting potential determinations in FIG. 2 is that the pitting potential of the tempered steel "Silver Fox XL" of the invention is higher than standard ferritic stainless steels such as AISI 409 & 430 but is still lower than the standard austenitic stainless steels such as AISI 304 & 316.

The corrosion resistance of the invented steel makes the steel ideal for use in razor blade applications that require superior corrosion performance but also makes the steel suitable for a number of other applications that currently use ferritic or martensitic stainless steels such as: doctor blades, flapper valves, cutlery and other cutting tools.

The invention claimed is:

1. Martensitic stainless steel to be used for making cutting tools, wherein the steel contains 0.40 to 0.55 wt % carbon, 0.8 to 1.5 wt % silicon, 0.7 to 0.85 wt % manganese, 13.0 to 14.0 wt % chromium, 1.0 to 1.5 wt % molybdenum and 0.2 to 0.4 wt % nickel, 0.02 to 0.04 wt % nitrogen, the balance of the steel being iron and inevitable impurities, and wherein the steel, after casting, hot rolling, annealing, cold rolling, hardening and tempering, has a Vickers hardness Hv1 between 700-780.

2. The martensitic stainless steel of the claim 1, wherein the steel contains 0.45 to 0.55 wt % carbon, 1.0 to 1.5 wt % silicon, 0.7 to 0.85 wt % manganese, 13.0 to 13.5 wt % chromium, 1.0 to 1.5 wt % molybdenum and 0.25 to 0.35 wt % nickel, 0.02 to 0.04 wt % nitrogen, 0 to 0.002 wt % boron, the balance of the steel being iron and inevitable impurities.

3. The martensitic stainless steel of the claim 1, wherein the steel further contains 0.010 to 0.015 wt % titanium.

4. The martensitic stainless steel of the claim 1, wherein the steel further contains 0.010 to 0.030 wt % tin.

5. Method for the manufacture of the martensitic stainless steel to be used for making cutting tools, which method comprises casting of molten steel, hot rolling, annealing, cold rolling, hardening and tempering, wherein the steps of hardening and tempering the cold-rolled steel consist of hardening at the temperature range between 1150 and 1200° C. and tempering at the temperature range between 130 and 280° C., which tempered steel has the Vickers hardness of Hv1 between 700-780, and wherein the steel contains 0.40 to 0.55 wt % carbon, 0.8 to 1.5 wt % silicon, 0.7 to 0.85 wt % manganese, 13.0 to 14.0 wt % chromium, 1.0 to 1.5 wt % molybdenum and 0.2 to 0.4 wt % nickel, 0.02 to 0.04 wt % nitrogen, the balance of the steel being iron and inevitable impurities.

6. Method of claim 5, wherein the pitting potential Ep500 is between 0.35 V and 0.52 V.

* * * * *